United States Patent [19]

Fagnant et al.

[11] 4,342,396

[45] Aug. 3, 1982

[54] ROTARY PARTS SEPARATOR

[75] Inventors: Norman A. Fagnant, Mendon, Mass.; James L. Young, Pascoag, R.I.

[73] Assignee: Nelmor Company, Inc., North Uxbridge, Mass.

[21] Appl. No.: 176,859

[22] Filed: Aug. 11, 1980

[51] Int. Cl.[3] ..... B07C 5/00

[52] U.S. Cl. ..... 209/546; 209/674; 209/911; 425/215

[58] Field of Search ..... 209/664, 616, 674, 675, 209/676, 677, 678, 679, 683, 682, 689, 546, 547, 911, 659; 133/3 R, 3 A-3 E; 425/215

[56] References Cited

U.S. PATENT DOCUMENTS

| | | | |
|---|---|---|---|
| 1,813,841 | 7/1931 | Fast | 133/3 R |
| 3,651,938 | 3/1972 | Sullentrop, Jr. | 209/663 |
| 3,982,632 | 9/1976 | DeLeon | 209/663 |
| 4,257,883 | 3/1981 | Frazier | 209/664 |
| 4,264,012 | 4/1981 | Paradis | 209/664 |

*Primary Examiner*—Allen N. Knowles

*Attorney, Agent, or Firm*—Kinzer, Plyer, Dorn & McEachran

[57] ABSTRACT

A parts separator for separating small parts from a mixture with larger members, comprising a vertical cylindrical separator baffle wall and a continuously rotating conical rotor mounted co-axially in the baffle; the upper surface of the rotor is radially corrugated with the outer ends of the corrugation "valleys" large enough to accept the small parts but not the larger members. A mixture deposited on the rotor at an input location moves downwardly and outwardly, so that the small parts fall into the corrugation valleys and then through an annular gap between the rotor and the baffle onto a floor at the base of the separator; the small parts are pushed along the floor and out through a small parts discharge port. The larger members ride down the corrugation peaks and come out through a different discharge port, comprising a large gap in the baffle wall. A proximity switch monitors separator operation and affords an alarm in the event of interruption; a friction clutch affords specific overload protection.

9 Claims, 3 Drawing Figures

ROTARY PARTS SEPARATOR

BACKGROUND OF THE INVENTION

In a multiple cavity mold used for the manufacture of molded resin parts, the individual mold cavities are connected by supply channels. During the molding process, these channels form elongated and inter-connected molded resin components customarily referred to as "sprues" and "runners." Most modern molding machines automatically sever the molded parts from these sprues and runners at the time the mold is opened. However, it remains necessary to sort the sprues and runners from the molded parts.

This sorting procedure can be and usually has been carried out manually, but it is a tedious, routine, and costly job. Parts separators for carrying out this sorting task are known, but have not been entirely satisfactory because they tend to be rather bulky and often are not adequately reliable in operation. One known type of parts separator employs a conveyor belt upon which the mixture of molded parts, runners and sprues is deposited. At the end of the conveyor belt the molded parts are discharged from the belt by gravity. An upwardly moving conveyor equipped with a multiplicity of fingers or like projections catches the larger sprues and runners and conveys them to a separate location. Examples of such conveyor belt parts separators are disclosed in Suellentrop et al. U.S. Pat. No. 3,651,938 and DeLeon et al. U.S. Pat. No. 3,982,632.

Another known parts separator disclosed in Frazier U.S. Pat No. 4,257,883, comprises a bowl having generally vertical sides; within that bowl, there is a continuously driven rotor of conical configuration with a series of upwardly directed fin-like projections. The periphery of the rotor has a close fit with the inner surface of the bowl. When a mixture of small molded parts, sprues, and runners is deposited on the rotor, the parts fall between the fins to the lower rotor surface but the runners and sprues are held up on the fins. Separation is achieved at two outlets displaced around the periphery of the bowl, one aligned with the lower rotor surface to receive the molded parts and the other permitting egress of the runners and sprues from the higher level defined by the tops of the fins. This rotary parts separator has a tendency to jam, particularly in the area of the discharge port for the runners and sprues. Furthermore, the relatively complex multi-fin rotor of this device presents a distinct economic disadvantage.

In many instances, it is highly desirable to locate a parts separator directly under the molding machine, in position to separate the molded parts from runners and sprues immediately on discharge from the mold. When this is done, the parts separator is not readily accessible and is difficult or impossible to observe. If a jam or other malfunction occurs, the parts separator, the mold, or both may be damaged unless adequate protection is provided.

SUMMARY OF THE INVENTION

It is a principal object of the present invention, therefore, to provide a new and improved rotary parts separator for separating small parts from a mixture of those small parts with larger members (e.g., runners and sprues), that effectively minimizes or eliminates the difficulties and disadvantages of previously known parts separators as discussed above.

A particular object of the invention is to provide a new and improved rotary parts separator for separating small parts from a mixture including larger members that is highly consistent in operation, that is compact in construction, and that has little tendency to jamming in continued operation.

Another object of the invention is to provide improved protection against overloads or other malfunctions in the operation of a rotary parts separator.

A further object of the invention is to provide a new and improved rotary parts separator, for separating small parts from a mixture including larger members, that is simple and economical in construction as compared with previously known devices.

Accordingly, the invention relates to a rotary parts separator for separating small parts, having a given maximum dimension, from a mixture of such small parts with larger members that have minimum principal dimensions larger than that maximum dimension. The parts separator comprises a cylindrical separator baffle having a vertical axis, a conical rotor mounted within the upper portion of the separator baffle in coaxial relation thereto, the upper surface of the rotor having a corrugated configuration defining a multiplicity of peaks extending outwardly and downwardly from the rotor apex and separated by a corresponding multiplicity of outwardly and downwardly diverging and deepening valleys, the peripheral portion of each rotor valley being wider and deeper than the maximum dimension of the small parts but not wide enough or deep enough to receive any of the larger members; the outer rim of the rotor is spaced from the separator baffle by an annular separation gap that is wide enough, at least at the rotor valley ends, to allow the small parts to fall therebetween at any point around the rotor periphery, but not wide enough for passage of the larger members. Drive means, including a drive shaft coaxial with the baffle axis, are provided for rotating the rotor in a given direction of rotation; input guide means guide a mixture of the small parts and the large parts onto the rotor at a predetermined input location, with both moving outwardly and downwardly by combined centrifugal and gravitational forces. Output guide means, located below the rotor, guide the small parts that fall through the separation gap into a small parts discharge port; a larger member discharge port is also provided, comprising an interruption in the separator baffle extending a substantial distance below the rim of the rotor, the larger member discharge port being located between the small parts discharge port and the input location.

DESCRIPTION OF THE PREFERRED EMBODIMENT

Figure 1:
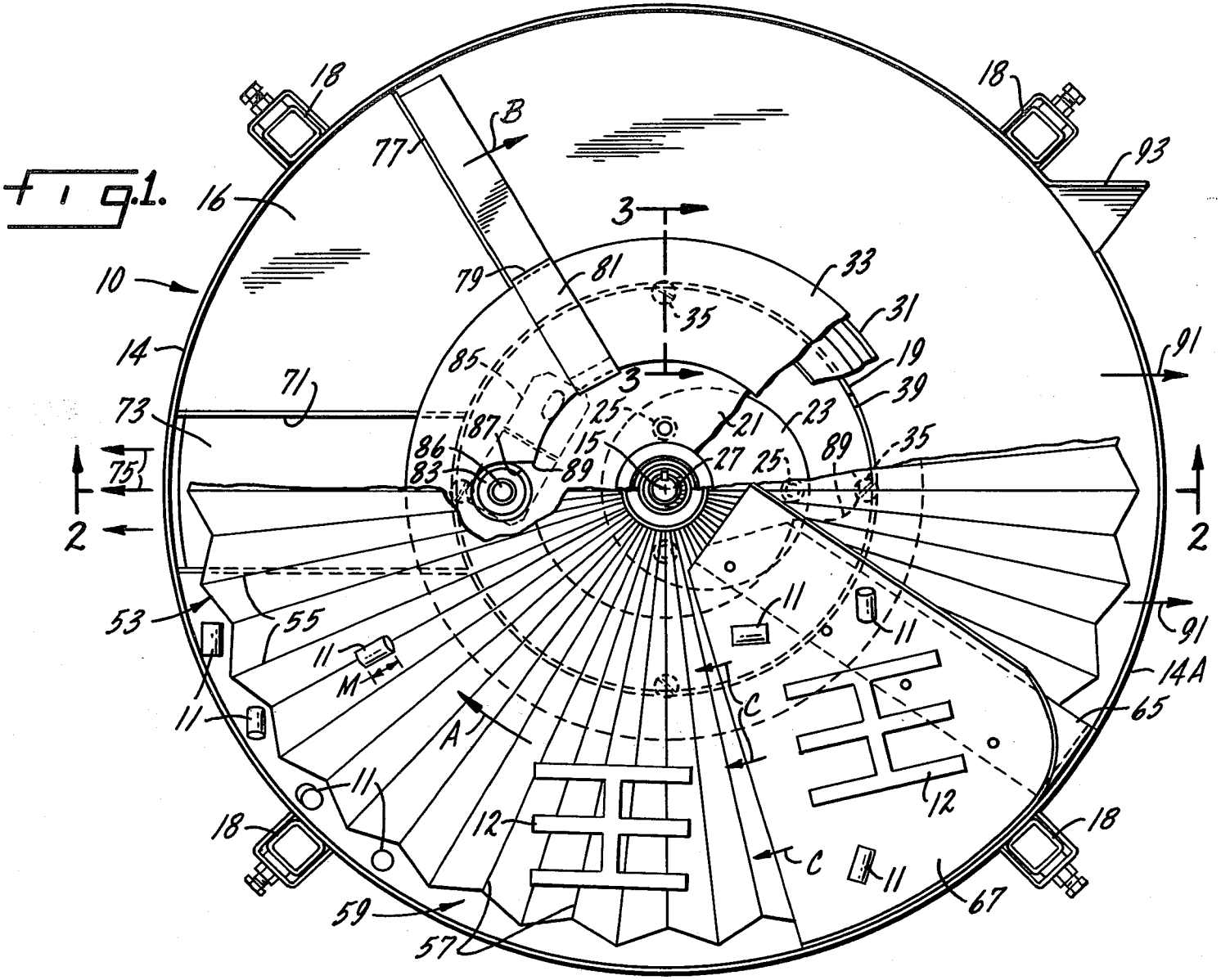
FIG. 1 is a plan view, partially cut away, of a rotary parts separator constructed in accordance with a preferred embodiment of the present invention.
Figures 2, 3:
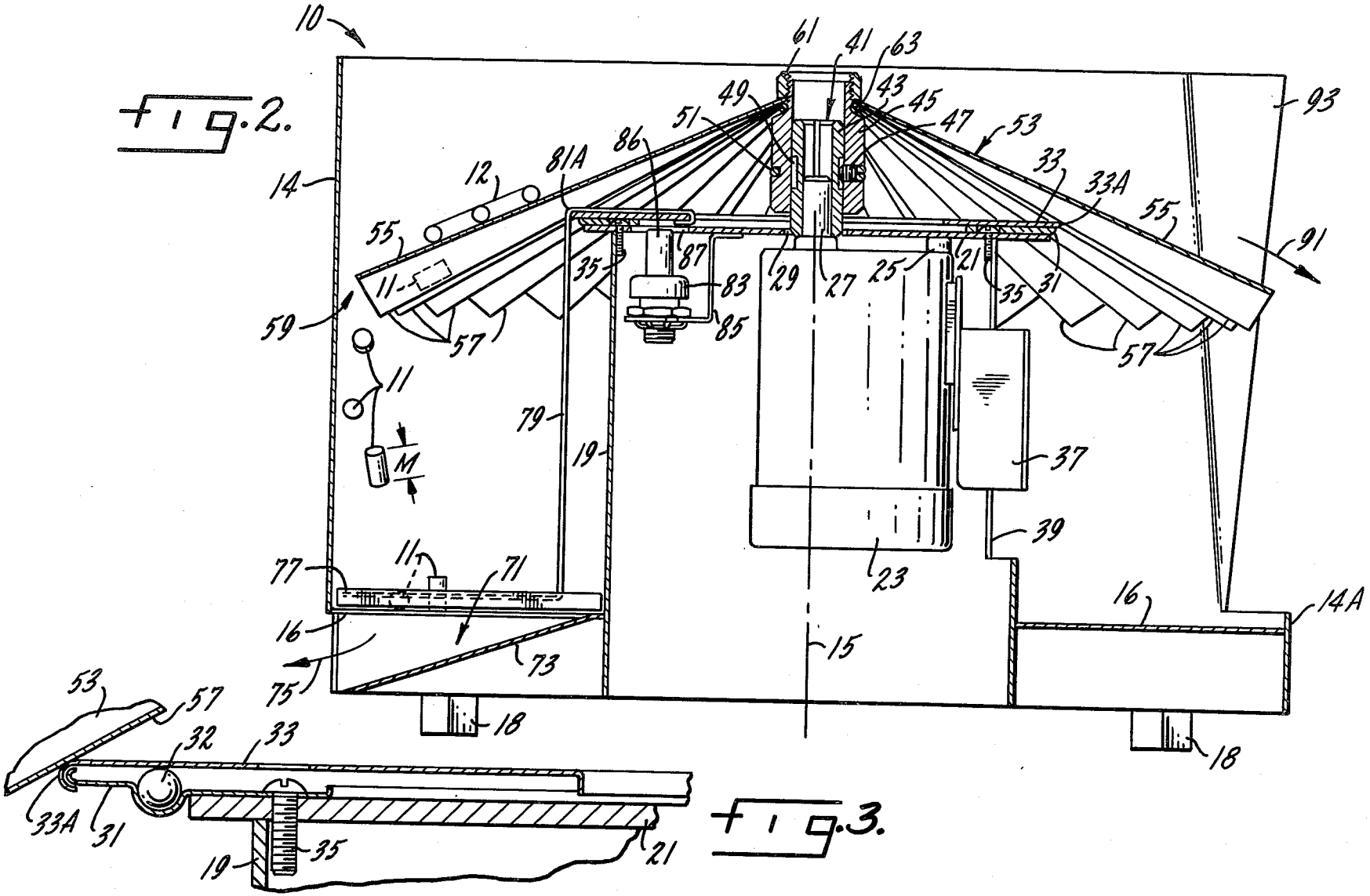
FIG. 2 is a sectional elevation view taken approximately along line 2—2 in FIG. 1.
FIG. 3 is a detail sectional view taken approximately along line 3—3 in FIG. 1.

FIGS. 1 and 2 illustrate a rotary parts separator 10 that is employed to separate small parts 11 from a mixture of those small parts with larger members 12. In a typical situation, the small parts 11 are molded resin parts constituting the desired output from an injection molding machine or other resin molding equipment, whereas the members 12 are larger runners and sprues that are formed as an incident to the molding process. Each of the small parts 11 has a given maximum dimension M; the members 12 have minimum principal dimensions that are larger than the maximum dimension M of the small parts.

Parts separator 10 comprises a cylindrical separator baffle 14 that is symmetrical with respect to a vertical axis 15. There is an annular floor 16 that extends inwardly of the vertical baffle wall 14 and that constitutes a part of the base of separator 10. The parts separator is supported upon four legs 18. The separator support legs 18 are preferably of a construction that permits vertical height adjustment, so that the overall height of the separator can be adjusted to cooperate with equipment that discharges a mixture of parts 11 and members 12 into the separator as described hereinafter. The particular structure adopted to provide for adjustability of the support legs 18 is not critical to the present invention; accordingly, their construction is not described in detail.

A motor enclosure 19 of vertical cylindrical construction, concentric about the vertical axis 15, is affixed to and projects upwardly from the inner edge of floor 16. A motor mounting plate 21 rests on the upper rim of the motor enclosure 19. A gear motor 23 is suspended from mounting plate 21, within enclosure 19, the motor being mounted on plate 21 by suitable mounting screws (not shown) extending into bosses 25 on the motor housing. The shaft 27 of motor 23 projects upwardly through an opening 29 in the motor mounting plate 21, coaxially with the vertical axis 15.

A "lazy" susan bearing is incorporated in parts separator 10, immediately above the motor support plate 21. This bearing comprises a stationary bearing member 31 and a rotary bearing member 33. The stationary bearing member 31 is secured to the motor mounting plate 21 by a series of depending mounting screws 35 that project through plate 21 to engage the inner surface of motor enclosure 19 to and thus assure concentric mounting of shaft 27, plate 21 and the stationary bearing member 31 relative to axis 15. The rims of the two bearing members 31 and 33 are interlocked and a series of ball bearings are engaged in an annular ball race provided by the two bearing members as shown in FIG. 3. An electrical connector box 37 (FIG. 2) mounted on the housing of motor 23 projects outwardly through an opening 39 in the motor enclosure 19 to prevent rotation of the motor.

A friction overload clutch 41 is mounted on motor shaft 27. Clutch 41 comprises a clutch bushing 43 that is keyed to shaft 27 for rotation therewith. A cone bushing 45 fits over clutch bushing 43. A plurality of nylon clutch pins 47 (only one shown) extend through individual apertures in the cone bushing 45 and into a peripheral slot 49 in the clutch bushing 43, being held in place by a relatively weak external clamp member 51. The construction for clutch 41, as shown, should be considered to be exemplary only; any other form of simple friction clutch subject to release on overload can be used as desired.

A conical rotor 53 is mounted within the upper part of the separator baffle 14 in coaxial relation to the axis 15. The body of rotor 53 is preferably of relatively light gauge sheet metal. Rotor 53 has a corrugated configuration defining a multiplicity of peaks 55 that extend radially outwardly and downwardly from the rotor apex and are separated from each other by a corresponding multiplicity of outwardly and downwardly diverging and deepening valleys 57. The peripheral portion of each rotor valley 57 is wider and deeper than the maximum dimension M of any of the small parts 11. However, the valleys 57 of rotor 53 are not wide enough or deep enough to receive any of the larger members 12.

The outer rim of rotor 53 is spaced from the vertical separator baffle 14 by an annular separation gap 59 that is wide enough, at least at the ends of the rotor valleys 57, to allow the small parts 11 to fall between the rotor and baffle 14 at any point around the periphery of the rotor. However, gap 59, particularly at the ends of the rotor peaks 55, is not wide enough to permit passage of any of the larger members 12 between the rotor and the baffle. In the preferred construction, as illustrated, the radial dimension for the rotor valleys 57 is the same as the radial dimension for the rotor peaks 55. This simplifies the construction of cone 53, permitting formation of the cone from a circular blank with no peripheral identations for either peaks or valleys, and produces a separator gap 59 that is wider at the outer ends of the valleys 57 than at the outer ends of the peaks 55.

A central aperture at the apex of the conical rotor 53 allows the rotor to be fitted over the upper portion of cone bushing 45. Rotor 53 is mounted on bushing 45 by means of a cone housing nut 61 that is threaded onto the top of bushing 45, pressing the cone against an O-ring 63 engaging a shoulder on the upper periphery of bushing 45. The valleys 57 of rotor 53 engage the rotary bearing member 33 at its outer rim 33A, as shown in FIGS. 2 and 3.

An elongated deflector mounting bracket 65 is affixed to the upper portion of baffle 14, as shown in FIG. 1. Bracket 65 extends across the upper portion of separator 10, terminating a short distance from the center of the separator. An input guide comprising a flexible deflector shield 67 is affixed to bracket 65 and extends downwardly from the bracket toward rotor 53. Shield 67 is generally triangular in configuration, with the base of the triangle closely adjacent to baffle 14. Thus, shield 67 affords an input guide means for guiding a mixture of small parts 11 and larger member 12 onto the surface of rotor 53 as described below.

About ninety degrees clockwise from the left-hand edge of deflector shield 67, as seen in FIG. 1, there is an opening 71 in the floor 16 of separator 10. Opening 71 provides access to an inclined chute 73 (FIG. 2) affording a small parts discharge port indicated by the arrows 75 in FIGS. 1 and 2. The small parts discharge arrangement for parts separator 10 further comprises output guide means to guide the small parts 11 into the discharge port 75. This output guide means comprises a wiper or sweeper 77 mounted on a support arm 79 that is clipped to the rotary bearing member 33 by a clip extension 81. Wiper 77 extends completely across floor 16 in close proximity to the floor, between the separator baffle 14 and motor enclosure 19, as shown in FIGS. 1 and 2.

Parts separator 10 further comprises a proximity switch 83 supported on a bracket 85 that is affixed to the motor support plate 21. The probe or sensor element 86 of switch 83 projects upwardly through an aperture 87 in plate 21 and into alignment with the rotary bearing member 33. The rotary bearing member 33 has two large slots 89 (FIG. 1) that continuously move past probe 86 of proximity switch 83 during operation of separator 10.

Diagonally across separator 10 from the small parts discharge port 75, as shown in FIG. 1, there is a discharge port, identified by the arrows 91, for the larger members 12. This discharge port 91 comprises a gap or interruption in the separator baffle 14 that extends a substantial distance below the rim of rotor 53 (see FIG. 2). The larger member discharge port 91 is located between the small parts discharge port 75 and the input location defined by the deflector shield 67, preferably being immediately ahead of the deflector shield as in the illustrated construction. There is a low rim 14A, a continuation of the baffle wall 14, across the bottom of the larger member discharge port 91. Rim 14A is only high enough to prevent discharge of small parts through port 91; it does not interfere with discharge of the larger members 12.

In the normal mode of operation parts separator 10 is positioned below an injection molding machine in alignment with the position at which the mold separates to discharge a mixture of small molded parts 11 with larger members (sprues and runners) 12. Motor 23 is energized, driving the conical rotor 53 through the friction coupling afforded by clutch 41. The direction of rotation is clockwise as indicated by arrow A in FIG. 1. The upper bearing member 33 is also rotated clockwise, due to the engagement of the valleys 57 of rotor 53 with the rim 33A of bearing member 33. The corner 81A of the wiper support arm 79 (FIG. 2) fits between two of the rotor valleys 57 and, accordingly, wiper 77 is also rotated clockwise as indicated by arrow B in FIG. 1.

When the mold of the molding machine opens, a mixture of small parts 11 and larger members 12, such as runners and sprues, cascades downwardly from the molding machine onto the input guide means comprising deflector shield 67. From the deflector shield, this mixture is guided onto the upper surface of rotor 53 as generally indicated by arrows C in FIG. 1; some of the parts and larger members may be deposited directly onto rotor 53 at the input location for parts separator 10, which is immediately to the left of the left-hand edge of deflector shield 67.

Because rotor 53 continuously rotates in the clockwise direction indicated by arrow A, both the small parts 11 and the larger members 12 move outwardly and downwardly over the upper surface of the rotor by the combined effect of centrifugal force and gravity. The small parts 11 fall into the valleys 57 of rotor 53 and ultimately drop through the gap 59 between the rim of the rotor and vertical baffle 14 onto the separator floor 16. Most of the small parts 11 reach the floor 16 ahead of the floor opening 71. However, others may fail to drop through gap 59 until after they have moved beyond gap 71. In either event, the continuously rotating wiper 77 sweeps the small parts 11 along floor 16 until they reach and fall through the opening 71. The small parts 11 then slide down chute 73 and out the small parts discharge port indicated by arrows 75. Gap 59, in its lower portion adjacent the outer ends of the rotor valleys 57, is made wide enough to preclude any jamming of small parts 11 between the rotor and the baffle 14.

The larger member 12 cannot fall into the rotor valleys 57. While riding down the top of the conical rotor 53, they remain supported on the rotor peaks 55 as shown in FIG. 2. When the larger members 12 reach the vertical cylindrical baffle 14, they cannot slip through gap 59; the top of the gap is too narrow to permit this to happen. Accordingly, larger members 12 ride around on top of rotor 53 until they reach the gap or interruption in the vertical baffle wall 14 that begins with the outwardly flared guide element 93. From that point on, there is no longer a baffle to hold the larger members 12 on rotor 53. Consequently, they are discharged outwardly through the large member discharge port as indicated by arrows 91.

In operation, the separation action of parts separator 10 is consistent and reliable. It is essentially impossible for any of the larger members 12 to be discharged through the small parts discharge port 75 because the larger members cannot reach separator floor 16. Even in those instances in which some of the small parts 11 are deposited on the floor 16 beyond the floor opening 71, they are prevented from being discharged through the larger member discharge port 91 by the short rim 14A along the bottom of the larger member discharge port. Accordingly, the sweeper 77 pushes these small parts around the necessary distance until they reach the floor opening 71 and are discharged through port 75 with the remainder of the small parts.

There is little or no tendency toward jams or other malfunctions of parts separator 10. In particular, the large size and open nature of the larger member discharge port 91 effectively precludes the jamming of the separator at this point that has been a frequent occurrence in previously known rotary parts separators. Nevertheless, virtually any mechanism is subject to a malfunction at one time or another. The rotary parts separator 10 is effectively protected in this regard.

In the unlikely event that a jam occurs in the operation of parts separator 10, as might happen in the case of a discharge of a larger member 12 of unusual configuration into the parts separator, the continuing rotation of shaft 27 and clutch bushing 43 pushes outwardly on the clutch pins 47 (FIG. 2), opening the relatively weak external clamp member 51. This releases clutch 41, disconnecting rotor 53 from shaft 27, and thus avoids overloading gear motor 23. It is thus seen that the friction clutch 41 provides effective overload protection in the event that a jam occurs preventing continuing rotation of rotor 53.

As discussed above, parts separator 10 is frequently mounted in a position in which it is difficult to observe its operation. Thus, in the event of a jam or other overload, or upon occurrence of a failure of drive motor 23, there is a substantial possibility that the resulting malfunction will not be readily apparent to operating personnel in the area. Protection against this circumstance is provided by proximity switch 83. The probe 86 of switch 83 provides an electrical output signal each time one of the slots 89 in the rotary bearing member 33 move past the probe. An interruption in these output signals can be utilized to actuate an alarm so that operating personnel can shut down the molding machine or other equipment with which the parts separator 10 is employed. This warning function can be quite important because accumulation of parts 11 and larger members 12 on top of a stationary cone 53 might reach the point at which the closing of the injection molding machine or other like equipment is prevented, with consequent substantial damage. No electrical alarm circuit or other protection circuit has been shown for use with the proximity sensor, switch 83, because a wide variety of conventional electrical circuits can be employed for this purpose.

Parts separator 10 is highly consistent in operation, compact in construction, and has little tendency toward jamming in continued operation. The parts separator is well protected against overloads or other malfunctions, including electrical failure. It is simple and economical in construction, as compared with previously known separators, particularly because rotor 53 can be stamped from a single circular blank of sheet metal. Furthermore, the support for the medial portion of rotor 53 that is provided by the rotating member 33 of the "lazy susan" bearing allows for use of light gauge sheet metal in fabrication of the rotor.

We claim:

1. A rotary parts separator for separating small parts, having a given maximum dimension, from a mixture of such small parts with larger members that have minimum principal dimensions larger than that maximum dimension, the parts separator comprising:

a cylindrical separator baffle having a vertical axis;

a conical rotor mounted within the upper portion of the separator baffle in coaxial relation thereto, the outer surface of the rotor having a corrugated configuration defining a multiplicity of peaks extending outwardly and downwardly from the rotor apex and separated by a corresponding multiplicity of outwardly and downwardly diverging and deepening valleys, the peripheral portion of each rotor valley being wider and deeper than the maximum dimension of the small parts but not wide enough or deep enough to receive any of the larger members, and the outer rim of the rotor being spaced from the separator baffle by an annular separation gap that is wide enough, at least at the rotor valley ends, to allow the small parts to fall therebetween at any point around the rotor periphery, but not wide enough for passage of the larger members;

drive means, including a drive shaft coaxial with the baffle axis, for rotating the rotor in a given direction of rotation;

input guide means for guiding a mixture of the small parts and the larger members onto the rotor at a predetermined input location, both the parts and the larger members moving outwardly and downwardly by combined centrifugal and gravitational forces;

output guide means, below the rotor, for guiding the small parts, falling through the separation gap, into a small parts discharge port located below the bottommost portion of the rotor rim;

and a large member discharge port, comprising an interruption in the separator baffle, extending a substantial distance below the rim of the rotor, the larger member discharge port being located between the small parts discharge port and the input location.

2. A parts separator according to claim 1 and further comprising an annular floor positioned a substantial distance below the baffle-rotor separation gap, the small parts discharge port comprising an opening in that floor, and in which the output guide means comprises a rotary sweeper, connected to the rotor drive means, for sweeping the small parts along the floor into the small parts discharge port.

3. A parts separator according to claim 1 or claim 2 in which the input guide means comprises a stationary deflector shield positioned above the rotor adjacent the input location and extending downwardly and circumferentially away from the larger member discharge port toward the input location to preclude direct access of the input mixture to the larger member discharge port.

4. A parts separator according to claim 3 in which the deflector shield is formed of flexible sheet material, extending from a position above the rotor down into engagement with the top surface of the rotor.

5. A parts separator according to claim 1 or claim 2, in which the radial dimension of each rotor valley is the same as the radial dimension of each rotor peak, so that the separator gap is wider at the outer ends of the rotor valleys than at the outer ends of the rotor peaks, and in which the rotor is formed from a single piece of light gauge sheet metal.

6. A rotary parts separator according to claim 5 and further comprising a friction clutch, subject to release under even moderate overload conditions, connecting the drive shaft to the rotor.

7. A rotary parts separator according to claim 5 and further comprising a large diameter lazy susan bearing mounted concentrically relative to the separator axis, in engagement with and supporting the medial portion of the rotor.

8. A rotary parts separator according to claim 7 and further comprising a proximity sensor, aligned with the rotary portion of the lazy susan bearing, for generating an electrical signal indicative of any interruption in rotation of the rotor.

9. A parts separator according to claim 5 in which the input guide means comprises a stationary deflector shield positioned above the rotor adjacent the input location and extending downwardly and circumferentially away from the larger member discharge port toward the input location to preclude direct access of the input mixture to the larger member discharge port.

* * * * *